US008624500B2

(12) United States Patent
Josefowicz et al.

(10) Patent No.: US 8,624,500 B2
(45) Date of Patent: Jan. 7, 2014

(54) SINGLE-ENDED PRIMARY INDUCTANCE CONVERTER (SEPIC) BASED POWER SUPPLY FOR DRIVING MULTIPLE STRINGS OF LIGHT EMITTING DIODES (LEDS) IN ROADWAY LIGHTING FIXTURES

(75) Inventors: Jack Josefowicz, Halibut Bay (CA); Shawn Winters, Stillwater Lake (CA); Donald Church, Halifax (CA)

(73) Assignee: LED Roadway Lighting Ltd, Halifax, Nova Scotia (CA)

( * ) Notice: Subject to any disclaimer, the term of this patent is extended or adjusted under 35 U.S.C. 154(b) by 91 days.

(21) Appl. No.: 13/389,374

(22) PCT Filed: Aug. 9, 2010

(86) PCT No.: PCT/CA2010/001223

§ 371 (c)(1),
(2), (4) Date: Apr. 5, 2012

(87) PCT Pub. No.: WO2011/014963

PCT Pub. Date: Feb. 10, 2011

(65) Prior Publication Data

US 2012/0280617 A1 Nov. 8, 2012

Related U.S. Application Data

(60) Provisional application No. 61/232,188, filed on Aug. 7, 2009.

(51) Int. Cl.
*H05B 37/02* (2006.01)

(52) U.S. Cl.
USPC ..... 315/85; 315/122

(58) Field of Classification Search
None
See application file for complete search history.

(56) References Cited

U.S. PATENT DOCUMENTS

| | | | | |
|---|---|---|---|---|
| 6,013,988 | A | 1/2000 | Bucks et al. | |
| 6,094,014 | A | 7/2000 | Bucks et al. | |
| 6,147,458 | A | 11/2000 | Bucks et al. | |
| 6,204,612 | B1 * | 3/2001 | Liu | 315/291 |
| 6,577,512 | B2 | 6/2003 | Tripathi et al. | |
| 6,586,890 | B2 | 7/2003 | Min et al. | |
| 6,788,195 | B1 | 9/2004 | Stegman et al. | |
| 7,030,572 | B2 | 4/2006 | Nijhof et al. | |
| 7,202,608 | B2 | 4/2007 | Robinson et al. | |
| 7,825,602 | B2 | 11/2010 | Hu et al. | |
| 8,002,440 | B2 | 8/2011 | Lan et al. | |
| 8,203,445 | B2 | 6/2012 | Recker et al. | |
| 8,264,172 | B2 * | 9/2012 | Valois et al. | 315/312 |
| 2003/0043529 | A1 | 3/2003 | Jacobs et al. | |
| 2004/0095081 | A1 * | 5/2004 | Kernahan | 315/307 |

(Continued)

OTHER PUBLICATIONS

Andrew O'Malley; International Search Report; Application No. PCT/CA2010/001223; Dec. 16, 2010; Canadian Intellectual Property Office.

(Continued)

*Primary Examiner* — Crystal L Hammond
(74) *Attorney, Agent, or Firm* — Stevens & Showalter LLP

(57) ABSTRACT

A lighting fixture and power supply are provided that allows a power factor correction (PFC) single ended primary inductance controller (SEPIC) that provides a controlled voltage output to provide a constant current to an LED load. The power supply provides an efficient and stable power supply for LEDs. Multiple power supplies can be provided on the same printed circuit board to control multiple LED channels.

24 Claims, 9 Drawing Sheets

(56) References Cited

U.S. PATENT DOCUMENTS

| | | | |
|---|---|---|---|
| 2008/0218100 | A1 | 9/2008 | Parikh |
| 2010/0117545 | A1 | 5/2010 | Kelly et al. |
| 2010/0134024 | A1 | 6/2010 | Brandes |
| 2010/0271178 | A1 | 10/2010 | Ahmad |
| 2011/0001626 | A1 | 1/2011 | Yip et al. |
| 2011/0109229 | A1 | 5/2011 | Akins |
| 2011/0215736 | A1 | 9/2011 | Horbst et al. |
| 2012/0075859 | A1 | 3/2012 | Granado et al. |
| 2012/0119647 | A1 | 5/2012 | Hsu |
| 2012/0146548 | A1 | 6/2012 | Campbell et al. |

OTHER PUBLICATIONS

Athina Nickitas-Etienne; International Preliminary Report on Patentability; Application No. PCT/CA2010/001223; Dec. 16, 2010; The International Bureau of WIPO.

* cited by examiner

SINGLE-ENDED PRIMARY INDUCTANCE CONVERTER (SEPIC) BASED POWER SUPPLY FOR DRIVING MULTIPLE STRINGS OF LIGHT EMITTING DIODES (LEDS) IN ROADWAY LIGHTING FIXTURES

CROSS-REFERENCE TO RELATED APPLICATIONS

This application claims priority from U.S. Provisional Application No. 61/232,188 filed Aug. 7, 2009, the entirety of which is hereby incorporated by reference.

TECHNICAL FIELD

The present disclosure relates to power supplies and in particular to power supplies for light emitting diodes (LED) for use in a roadway or external lighting fixture.

BACKGROUND

Roadway or street lighting fixtures are exposed to a range of environmental factors that impact performance and longevity of lighting fixtures. Existing roadway lighting commonly uses high-intensity discharge lamps, often high pressure sodium lamps (HPS). The power supply designs have been relatively simply but the light quality, efficiency and controllability of the fixtures has been less than ideal. The introduction next generation lighting fixtures such as light emitting diode (LED) based lighting fixtures provides greater efficiency, light quality and controllability however present challenges in ensuring reliable operation for the life of the lighting fixture. Factors such as thermal control, power efficiency, current regulation and packaging constraints must be accounted for to meet operation requirements. The temperature extremes and packaging restraints require an efficient design to ensure reliability. Providing a power supply that meets the demanding design requirements and cope with environmental extremes has not to date been achievable. In addition, single-ended primary inductance converters (SEPIC) have only been utilized in single channel configurations due to interference between channels.

Accordingly, apparatus and methods that enable an improved LED power supply remains highly desirable.

SUMMARY

In accordance with an embodiment of the present disclosure there is provided a power supply for providing a constant current to a light emitting diode (LED) load. The power supply comprises a power controller receiving an alternating current (AC) input and providing a direct current (DC) output voltage controlled to maintain a constant feedback voltage, the DC output voltage provided to a high side of the LED load, the DC output voltage relative to a common power line coupled to a low side of the LED load and the power controller; a current sense resistor connected in series on the high side of the LED load; a current sensing circuit coupled across the current sense resistor providing a reference current at an output line proportional to a current sense voltage across the current sense resistor; and a current selector resistor coupled between the output line of the current sensing circuit and the common power line coupled to the low side of the LED load, the current selector resistor and the reference current generating a current-sensed voltage for use as the feedback voltage used by the power controller wherein the DC output voltage provided by the power controller is controlled to provide a constant current to the LED load.

In accordance with a further embodiment of the present disclosure there is provided a lighting fixture for mounting above an illumination surface. The lighting fixture comprises a housing supporting a light emitting diode (LED) light string for illuminating the illumination surface; and a power supply for providing a constant current to a light emitting diode (LED) load. The power supply comprises a power controller receiving an alternating current (AC) input and providing a direct current (DC) output voltage controlled to maintain a constant feedback voltage, the DC output voltage provided to a high side of the LED load, the DC output voltage relative to a common power line coupled to a low side of the LED load and the power controller; a current sense resistor connected in series on the high side of the LED load; a current sensing circuit coupled across the current sense resistor providing a reference current at an output line proportional to a current sense voltage across the current sense resistor; and a current selector resistor coupled between the output line of the current sensing circuit and the common power line coupled to the low side of the LED load, the current selector resistor and the reference current generating a current-sensed voltage for use as the feedback voltage used by the power controller; wherein the DC output voltage provided by the power controller is controlled to provide a constant current to the LED load.

In accordance with a further embodiment of the present disclosure there is provided a method of controlling a lighting fixture. The method comprises rectifying an alternating current (AC) input; producing a controlled voltage output from the AC input using a single ended primary inductance converter; producing a sensing current proportional to the controlled voltage output using a current sense resistor in series with the controlled voltage output and a current sensing circuit connected across the current sense resistor; generating a feedback voltage using the sensing current and a current selector resistor; and adjusting the controlled voltage output to maintain the feedback voltage at a reference voltage, wherein the controlled voltage output provides a constant current to an light emitting diode (LED) load.

BRIEF DESCRIPTION OF THE DRAWINGS

Further features and advantages will become apparent from the following detailed description, taken in combination with the appended drawings, in which.

It will be noted that throughout the appended drawings, like features are identified by like reference numerals.

DETAILED DESCRIPTION

A single-ended primary inductance converter (SEPIC) power supply for driving multiple strings of light emitting diode (LED) lamps in lighting fixtures is provided. High power factor and high efficiency are realized in a single-stage architecture. The SEPIC architecture described herein uses the ripple steering technique to reduce the switching frequency components of the input current. Other advantages of the SEPIC power supply include reduced inrush current, inherent output short circuit protection, and reduced electromagnetic emissions. High reliability and a long operating lifetime to match the lifetime LEDs are major requirements for the power supplies. This requirement may be achieved by partitioning the power of the lighting fixture into a plurality of power supplies which may help to keep all semiconductor junction temperatures below 100° C.

The LED lighting fixture can comprise multiple channels of LEDs, with each channel comprising one or more strings of LEDs, to provide control in light distribution and light intensity. In an embodiment a four channel configuration can be utilized, with 24 LEDs per channel, although any number of channels and LED configurations can be utilized. Each LED may have a nominal voltage drop of 3.0V. Since the voltage across each LED string can be less than the minimum AC input voltage, the SEPIC topology works well in this application. The SEPIC disadvantages of higher voltage and current stresses are mitigated by splitting the converter into four power supplies, with lower power dissipation for each. This architecture also allows the lighting fixture to operate at any one of a plurality of light intensities by switching each power supply independently to control the cumulative light intensity.

Figure 1:
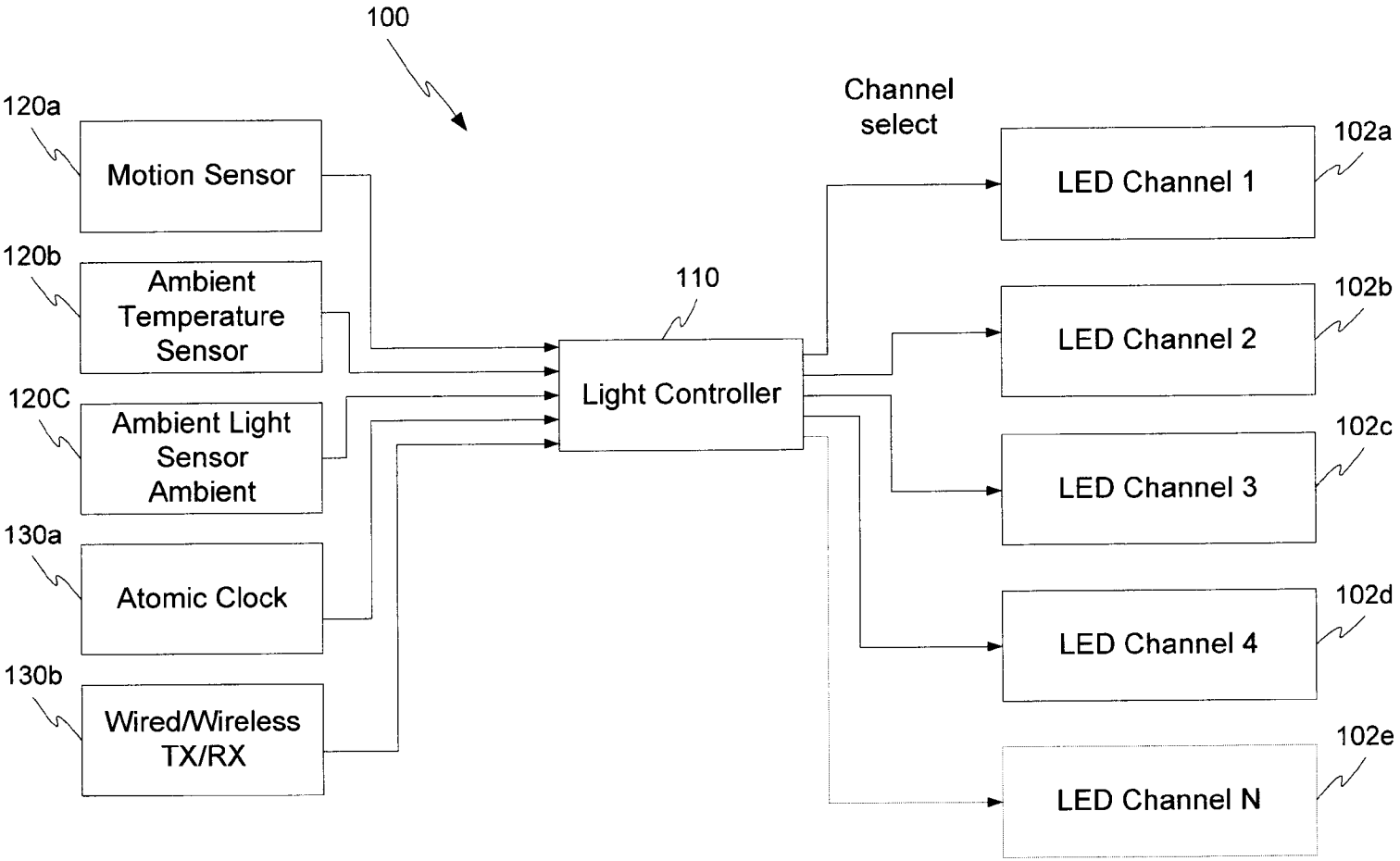
FIG. 1 depicts in a block diagram components of a lighting fixture.

FIG. 1 depicts in a block diagram components of a lighting fixture 100. The lighting fixture 100 uses light emitting diodes (LEDs) to illuminate a surface. The lighting fixture 100 may typically be mounted above an illumination surface. The lighting fixture 100 may comprises one or more LED channels 102*a*, 102*b*, 102*c*, 102*d*, 102*n* (referred to generally as 102). Each of the LED channels 102 may comprise a power supply and one or more LED strings. For example each LED channel may comprise 25 LEDs, as 2 strings of 12 LEDs each connected in series. As described further herein, each power supply provides a constant current to the one or more LED strings of the LED channel 102. Each power supply receives power from a connection to an alternating current (AC) source such as an AC mains connection.

The lighting fixture 100 is depicted as having four LED channels 102*a*, 102*b*, 102*c*, 102*d*, although fewer or additional LED channels may be used. The lighting fixture may include a light controller 110 that controls the operation of the lighting fixture, and in particular controls the operation of power supplies of the LED channels 120. The light controller 110 may comprise a micro controller device such as an Atmel ATtiny85. The micro-controller may be programmed to accept data from external sensors and to produce signals to control the output from the LEDs. The LED output can be triggered by, motion detection, time of night dimming, temperature compensation, wireless control, etc. The light controller 110 may control the LED channels 120, for example to turn on or off individual LED channels 120 in order to control the illumination output of the lighting fixture 100, based on input from one or more input components. The input components may include one or more input sensors for measuring at least one variable. The one or more input sensors may include a motion sensor 120*a* for detecting and measuring movement, an ambient temperature sensor 120*b* for measuring ambient temperature levels or an ambient light 120*c* sensor for measuring ambient light levels. Additional input sensors may be used, such as an output light sensor for measuring light levels output by the light sensor or a fixture temperature sensor for measuring a temperature of the lighting fixture. The controller 110 may receive additional input from one or more input components comprising, for example, an atomic clock 130*a* for generating a time based signal or a wired or wireless transceiver 130*b* for receiving and/or transmitting communication messages to a control unit.

Although not depicted in FIG. 1, it will be appreciated that the components used in the lighting fixture 100 may be mounted in an appropriate housing. Further, various components may be mounted remote from the housing of the lighting fixture 100. For example, an ambient temperature sensor may be mounted remote from the lighting fixture 100 such as at a base of a mounting pole used to mount the housing of the lighting fixture 100 above an illumination surface.

As shown in FIG. 1, multiple LED channels 102 can be controlled by a single light controller 110 to control overall light output of the lighting fixture 100. Each LED channel 102 can be controlled by light controller 110. Light controller 110 can provide input to individual LED channels to control the output of the channel based upon external input provided to the lighting fixture 100. Light controller 110 may control the operation of the LED channels based on inputs provided to the light controller 110. The light controller may receive input from a motion sensor 120*a* to detect motion and turn on one or more LED channels only when motion is detected in order to conserve power. This may apply to a situation where the LED channels are turned off during low traffic periods, typically after midnight.

A wired (Ethernet, or power line communication, etc.) or wireless (WiFi, WiMax, paging, etc.) transmit/receive interface 130*b* may be provided to allow the light controller to turn on or off and/or dim, and/or monitor performance remotely either through direct wireless communication or through wireless networks. The light control may control the illumination level by turning on or off one or more LED channels. Obviously the illumination provided by a single LED channel is less than the illumination level provided by all LED channels 120.

An ambient light sensor 120*c* and/or light output sensors may be provided to monitor LED output and daylight to control the desired light output. For example, less light may be required at dusk or dawn, and so the light controller may detect the ambient light conditions using the ambient light sensor 120*c* and turn on an appropriate number of LED channels 120 to provide the desired illumination level for the measured ambient light level.

An atomic clock input 326 may also be provided to ensure timing synchronization. Other types of input such as temperature values may also be provided to improve efficiency of the power supply or trigger operation of the lighting fixture 100.

In addition to controlling the illumination level of the lighting fixture by controlling the number of LED channels 102 turned on, the light controller 110 may also control the brightness of each individual LED channel 120. The brightness of an LED channel is determined by the current passing through the LED strings. Depending on the design of the power supply of the LED channel, it may be possible to vary the current provided to the LED strings.

If it is possible to control the current provided to the LED strings of an LED channel 120, the light controller 110 may be configured to provide additional control over the LED channels. For example, the light controller 110 may adjust the current provided to an LED string in order to account for the aging of the LEDs. As LEDs age, they require additional current to produce the same output light levels. The light controller 110 may count each power on sequence of an LED channel and store it into internal memory to keep track of how long each LED channel has been in operation. In order to reduce false counting of days due to power brown outs or outages etc, the controller may only count a day if the LED channel is on for a minimum of four hours. The day counter is not meant to be precise, but a general indication of how long the LED channel had been in use. With this scheme, the light controller can be programmed to control the current to the LED strings.

Figure 2:
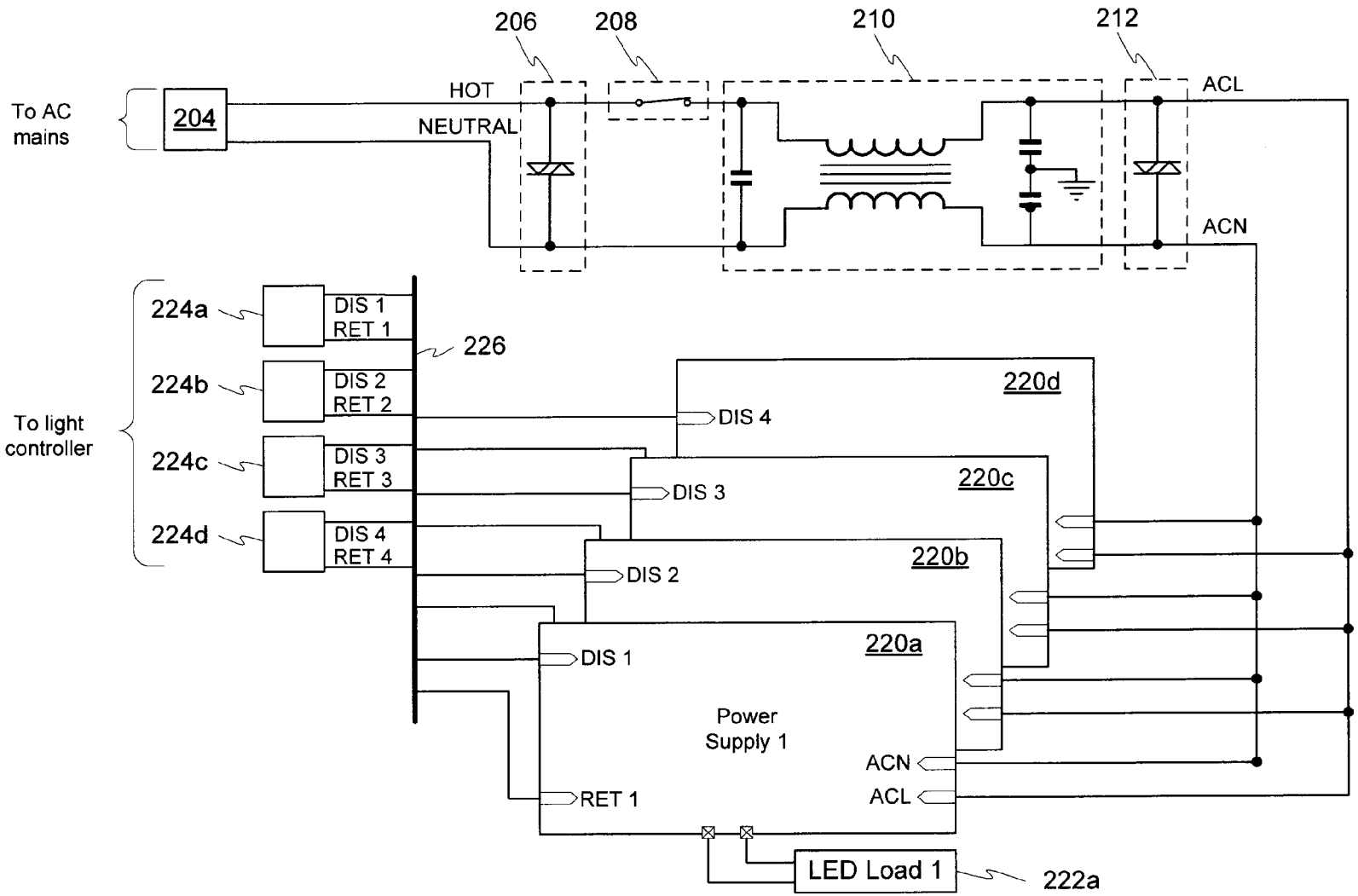
FIG. 2 depicts in a schematic components of a portion of a lighting fixture.

FIG. 2 depicts in a schematic components of a portion of a lighting fixture, which may be for example lighting fixture 100. The components include an input circuit 202 and four LED channels, each comprising a power supply connected to an LED load as well as connections to a light controller, such as light controller 110.

The input circuit 202 comprises a connection 204 for connecting the input circuit 202 to an AC mains power source. The input circuit includes a primary surge protector 206 which may comprise a varistor connected across the hot and neutral lines of the AC input. The input circuit 202 may further comprise a thermal protector 208 in series in the hot line of the AC input. The thermal protector 208 may provide a temperature operated switch which opens above a threshold temperature, such as for example 95° Celsius. The input circuit 202 may further comprise an electro magnetic interference (EMI) filter 210 The EMI filter may comprise a capacitor coupled across the hot and neutral lines of the AC input, an inductor in series in the hot and neutral lines of the AC input and a pair of capacitors connected in series with each other across the hot and neutral lines of the AC input. The capacitors may be connected to earth ground at the connection point between the two capacitors. The EMI filter 210 limits any conducted interference introduced by the power supplies of the lighting fixture to the utility grid. The EMI filter 210 removes harmonic noise and conducted emissions that could transfer to the utility grid. The input circuit 202 provides a live AC line (ACL) and a neutral AC line (ACN) that is distributed to the power supplies of the individual LED channels. The input circuit 202 may further include a secondary surge protector 212 connected across the output lines from the EMI filter 210.

Each LED channel 102 of FIG. 1, may comprise an individual power supply 220*a*, 220*b*, 220*c*, 220*d* (referred to collectively as 220) connected to the ACL and ACN provided by the input circuit. Each LED channel may further comprise an LED load 222*a*. It should be appreciated that although only a single LED load 222*a* is depicted in FIG. 2, each individual power supply 220*b*, 220*c*, 220*d* would also be connected to a respective LED load (not shown). Each LED load (referred to generally by 222) may comprise one or more LED strings. Each LED channel may further comprise connectors 224*a*, 224*b*, 224*c*, 224*d* (referred to generally as 224) for coupling the individual control lines, including a disable line (DIS1, DIS2, DIS3, DIS3) used to disable respective individual power supplies, and a return line (RET1, RET2, RET3, RET4) which may provide an isolated ground plane for each individual power supply. The connectors 224 may form part of the respective power supplies 220 or the may be coupled to the respective power supplies 220 through a signal bus 226.

Although FIG. 2 depicts the individual power supplies 220 as being separate, they may be manufactured on the same printed circuit board (PCB), which may simplify the manufacturing process, reduce cost, and/or provide a more convenient form factor. Multi channel power supplies realized on a single PCB without isolation, are susceptible to interference and noise from adjacent channels. The switching frequency of each channel may not be exactly the same and so cause noise to form on the common neutral line which is passed on to the RET lines of each channel. The result is an unstable channel ground and fluctuating output. To overcome this, each power supply 220 has been isolated as much as possible from each other. Separate RET/ground planes are provided for each power supply and each power supply has its own bridge network for rectifying the AC input on the ACL and ACN lines.

Figure 3:
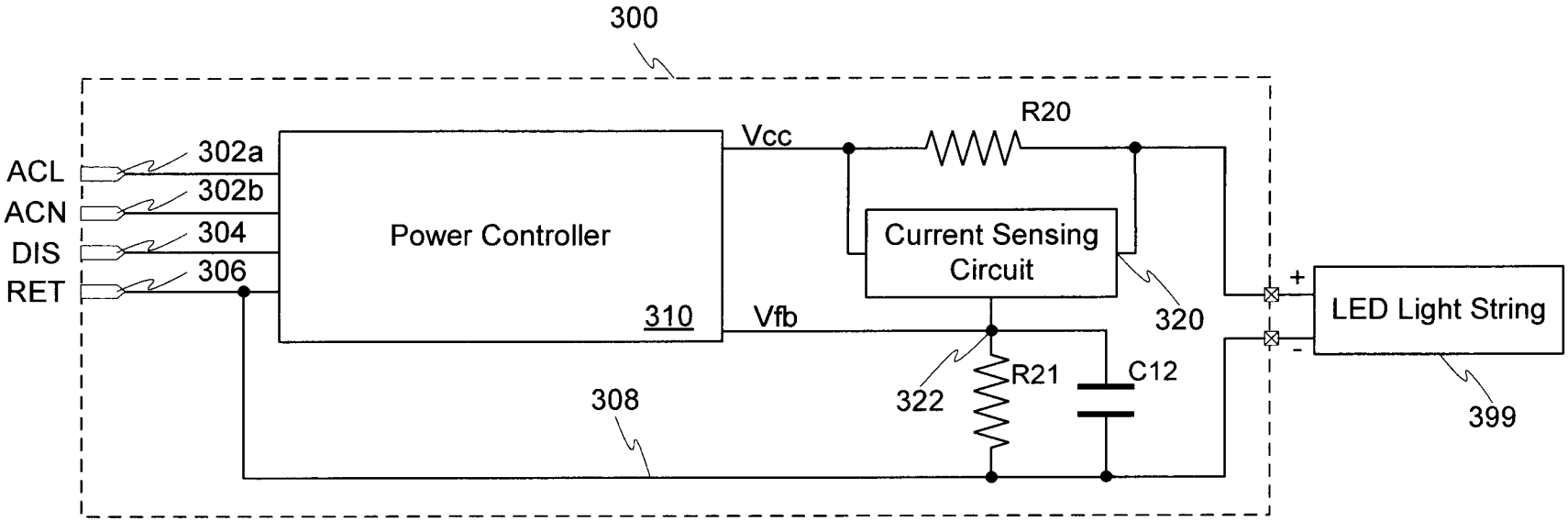
FIG. 3 depicts in a schematic components of a power supply for use in a lighting fixture.

FIG. 3 depicts in a schematic components of a power supply 300 for use in a lighting fixture, for example lighting fixture 100 of FIG. 1. The power supplies 220 of FIG. 2 may comprise a power supply such as power supply 300. The power supply 300 includes ACL connection 302*a* and ACN connection 302*b* for receiving the AC input. The power supply 220 also includes a DIS connection 304 and a RET connection 306. The DIS connection 304 provides a connection to a controller, such as light controller 110 of FIG. 1, that may be used to disable the power supply 300 so that no current will flow through the LED light string 399 connected to the power supply 300. The RET connection 306 may connect a common power line 308 to a ground plane of the lighting fixture. The common power line 308 may be connected to a low side of the LED light string 399 as well as the power controller.

The power supply includes a power factor correction (PFC) single ended primary inductance controller (SEPIC) power controller 310. The power controller 310 provides a controlled voltage Vcc as output. The controlled voltage output Vcc is controlled by the power controller 310 based on a feedback voltage supplied to the power controller 310. The power controller 310 adjusts the controlled output voltage in order to maintain, or to try to maintain, the feedback voltage at a particular voltage.

The typical configuration of a PFC SEPIC power controller provides a constant output voltage where the output current will vary depending on the load that is connected. The use of a PFC SEPIC power controller to directly power an LED string would result in the voltage across the LED load being maintained constant, which would in turn result in a varying current passing through the LEDs. The varying current would results in flickering or pulsing in the light which is undesirable.

In order to use a PFC SEPIC power controller 310 to power LED light string 399 with a constant current, a feedback circuit is added in order to generate the feedback voltage used by the PFC SEPIC to maintain the output voltage Vcc. The feedback circuit comprises a current sense resistor R20 connected in series on a high side of the LED light string 399. The current sense resistor R20 generates a voltage across it that is proportional to the current passing through it, and so passing through the LED string 399. A current sensing circuit 320 connected across the current sense resistor R20 senses the voltage and generates a reference current at an output line 322. The reference current is proportional to the sensed voltage across the current sense resistor R20. In order to generate the feedback voltage required by the power controller 310, a current selector resistor R21 is connected between the output line 322 and the common power line 308. The feedback voltage is generated across the current selector resistor R21 and is proportional to the reference current, which in turn is proportion to the voltage across the current sense resistor R20, which in turn is proportional to the current flowing through the current sense resistor R20 and the LED light string 399. The power controller 310 adjusts the controlled output voltage Vcc to maintain the feedback voltage Vfb at a reference voltage. Since the feedback voltage Vfb is based on the current flow through the LED light string 399, the power controller 310 adjusts Vcc to maintain Vfb, which results in the power controller providing a constant current to the LED light string 399. The components providing the feedback voltage loop are chosen so that the total loop transfer function is the same is if the output voltage was being regulated directly.

The power controller 310 attempts to maintain the feedback voltage Vfb at a reference voltage. The feedback voltage is generated by the reference current passing through the current selector resistor R21. As such the constant current provided to the LED light string 399 by the power controller 310 can be varied by adjusting the resistance of the current selector resistor R21. By selecting a smaller resistance for current selector resistor R21, a larger reference current will need to pass through it in order to produce the same feedback voltage Vfb. The voltage drop across R20 will need to be larger in order to increase the reference current. In order to increase the voltage drop across R20, in order to provide the feedback voltage, the current passing through the resistor R20 must be larger, as compared to the current passing through the current sense resistor R20 when a larger current selector resistor R21 is used.

In addition to the current sense resistor R20, current sensing circuit 320 and current selector resistor R21, the power supply 300 may further comprise a current sense ripple filter capacitor C12. The current sense ripple filter capacitor C12 may be installed in parallel with R21 to help reduce excessive ripple on the reference current waveform which can cause the power controller 310 to become unstable.

Figure 4:
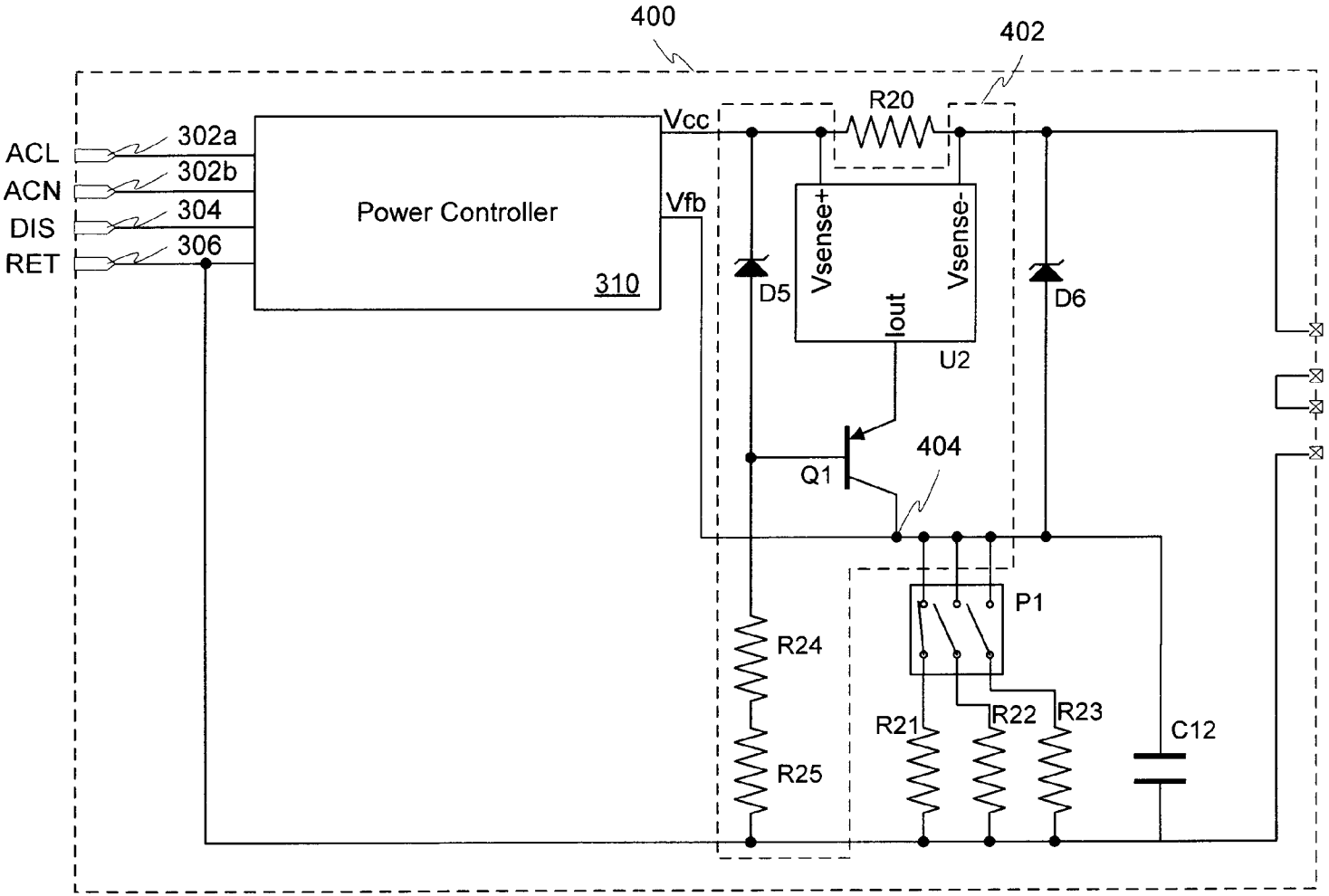
FIG. 4 depicts in a schematic components of a power supply for use in a lighting fixture.

FIG. 4 depicts in a schematic components of a power supply 400 for use in a lighting fixture. The power supply 400 is similar to the power supply 300 of FIG. 3; however it includes additional components that may increase the protection of the circuits, or provide increased functionality or simplify manufacturing. Components of the power supply 400 that function the same way as the corresponding components in power supply 300 are not further described with reference to FIG. 4.

The current sensing circuit 402 is coupled across the current sense resistor R20. The current sensing circuit 402 comprises a high side current mirror U2 the sense the voltage across the current sense resistor and provides an output current Iout that is proportional to the sensed voltage across the current sense resistor R20. The current sensing circuit 402 further includes protection circuit that comprises a zener diode D5 connected to the high side of current sense resistor R20. The zener diode D5 is connected in series with two resistors R24 and R25. A p-type transistor Q1 has its base connected between the zener diode D5 and the resistor R24. The emitter of transistor Q1 is connected to the output of the high side current mirror U2. The collector of transistor Q1 provides a reference current at an output line 404.

In contrast to power supply 300 which included a single current selector resistor R21, the power supply 400 comprises a plurality of current sense resistors that can be connected to the output line 404 by a plurality of switches. Each resistor may be connected to the output line 404 through a respective switch. As depicted in FIG. 4, the switches may be a simple jumper selector P1. Using a jumper to select the current selector resistor R21, R22, R23 does not allow a different value of resistor to be selected, and so change the current provided to the LED load, since physical access to the lighting fixture is required. However, this arrangement may be beneficial from a supply management perspective since a single part can be used to provide multiple currents and so it is not necessary to maintain multiple part numbers. Furthermore, the jumper may be repositioned to select a different resistor as the lighting fixture ages and so provide additional current to the LEDs causing them to be brighter.

The switches used for selecting the current sense resistor R21, R22, R23 may be controlled by a signal. For example the switches may be implemented using a transistor. Each transistor may be turned on, and so connect the associated resistor to the output line, by a signal line (not shown) that may be controlled by the light controller of the lighting fixture. Having controllable switches connecting the current selector resistors to the output line can allow the light controller to change the value of the current selector resistor during operation of the lighting fixture changing current supplied to the LEDs and so the brightness of the LED strings.

The power supply 300 of FIG. 300 depicts an LED load 399 connected to two contacts. The power supply 400 of FIG. 4 comprises 4 contacts allowing two LED strings to be connected in series. This may allow the power supply 400 to power more LED, or allow the power supply to power the same number of LEDs, but have smaller LED strings.

The power supply may also comprise a no load protection circuit for protecting the circuit when no load is present. If no load is present, the feedback voltage Vfb will be zero and the power controller will continually increase the controlled output voltage Vcc which may cause damage. The no load circuit allows a feedback voltage Vfb to be generated even when no load is connected and so limits the maximum controlled output voltage Vcc that will be generated. In the power supply 400 the no load protection circuit is a zener diode Z6 connected across the low side of current sense resistor R20 and the output line 404.

Figure 5:
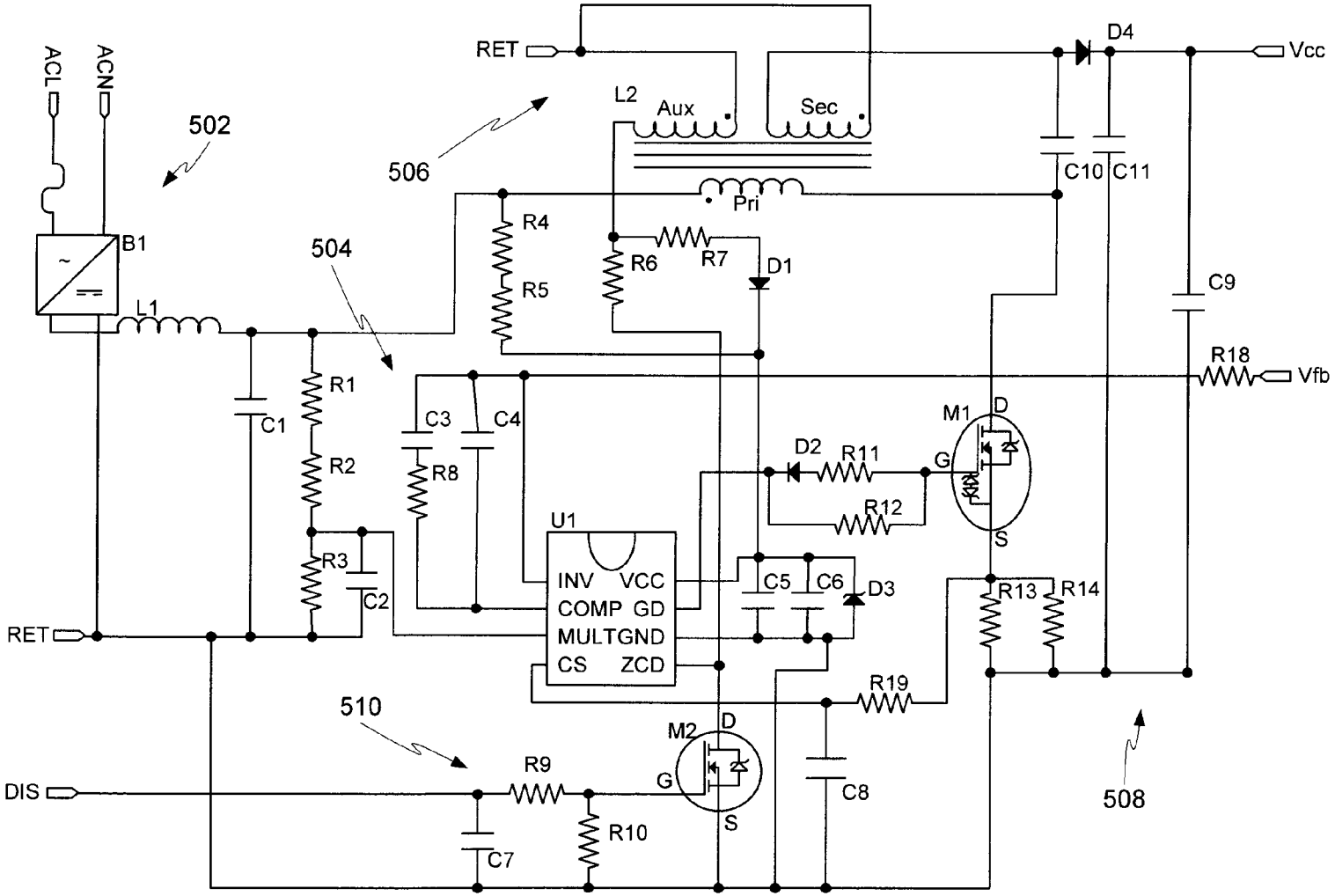
FIG. 5 depicts in a schematic components of a PFC SEPIC power controller for use in a power supply of a lighting fixture.

FIG. 5 depicts in a schematic components of a PFC SEPIC power controller 500 for use in a power supply of a lighting fixture. The power controller 500 may be used in for example power supply 300 or power supply 400. The power controller 500 comprises a bridge rectifier block 502 that converts the AC input on ACL line and ACN line to a DC input for a power factor correction (PFC) circuit 504. The PFC circuit 504 receives the now rectified AC signal to produce a lower voltage by Buck/Boost inductor 506. The buck/boost inductor 506 converts high DC voltage to lower DC voltage. Output rectification and filtering block 508 are provided to reduce ripple from voltage and current to provide a cleaner output voltage Vcc. The reduced voltage waveform Vcc is provided to drive the LEDs as described above. The feedback voltage is provided to the PFC circuit 504 which adjusts the power controller to control the output voltage Vcc so that the feedback voltage will be maintained at a reference voltage.

The PFC circuit may include a current mode PFC controller U1 which operates in transition mode, on the boundary between discontinuous and continuous current in the input inductor (Pri). The PFC controller U1 has a fixed on time and a variable frequency. This type of controller is simpler than the more conventional fixed frequency, average current mode controller.

In steady-state operation, the input (Pri) and output (Sec) inductors see the same voltage. The output diode sees the sum of the input and output voltages. The MOSFET M1 current is the sum of the currents in the input and output inductors. Likewise, the voltage across the MOSFET M1 is the sum of the input and output voltages, which is also seen by the main capacitor, C10. These observations can be used to determine component voltage and current ratings for the design.

The AC input into the power controller is converted to a full-wave rectified sine with an rms value of Vpk/√2, where Vpk is the peak voltage of the AC input. The PFC controller U1 senses both the MOSFET M1 current and the actual value of the rectified mains voltage. Operating in the 40 kHz to 100 kHz frequency range, the MOSFET M1 turns on and remains on until a current limit is reached, when it switches off. The current limit is proportional to the input voltage and thus the peak current in the MOSFET M1 is quasi-sinusoidal and in-phase with the mains voltage. Thus the power factor is very close to 1 and so provides high efficiency. The bandwidth of the controller is kept very low (typically <30 Hz) to keep the power factor high.

The PFC controller U1 may have an internal error amplifier and reference voltage for control of the output voltage in a standard boost PFC pre-regulator. Normally, the output voltage would be sensed by a voltage divider and the feedback voltage fed back to the error amplifier. However, as described above, the feedback voltage is provided by a high side current mirror, which allows the power controller 500 to provide a constant current output.

The power controller 500 may also include a disable input line (DIS) that allows the power controller 500 to be turned off. A channel control block 510 receives the disable signal and applies the appropriate control to the PFC controller U1 to turn off the power controller 500.

A power supply according to the above description may be designed by determining the input and output characteristics and determining the appropriate components to use. For example the design can be based upon the input specifications shown in Table 1.

TABLE 1

Input Specifications

| Quantity | Value |
|---|---|
| Mains voltage range: Vacmin - Vacmax | 85 Vacrms-132 Vacrms |
| Regulated DC output voltage - Vo | 72 V |
| Rated Output power - Po | 20.16 W |
| Minimum switching frequency - fswmin | 45 kHz |
| Maximum over-voltage permitted - Δvovp | 12 V |
| Maximum output voltage ripple - Δvo | 2.5 V |
| Expected efficiency - η | +93% |
| Maximum mains rms current - linrmsmax | Po/(η * Vacmin) = 255 mA |
| Rated output current - Io | Po/Vo = 280 mA |
| Output equivalent resistor - Ro | Vo^2/Po = 257 Ω |

ΔVo is ½ of the output voltage ripple at twice the line frequency. It is usually set between 1% and 5% of the output voltage. 3.5%*72V=2.5V is selected, to minimize the size of the output filter capacitor.

If the output capacitor ESR is low, then Cout should be a minimum of:

$$Cout \geq Io/(4*pi*fl*\Delta Vo)=148\text{ uF}$$

The maximum over voltage permitted is set to approximately 15% of the output voltage.

From the specifications we can now calculate the peak MOSFET M1 current as 1.74 A and the rms current as 0.482 A. The minimum MOSFET M1 breakdown voltage is 306V. A 400V, 9 A part is selected. Based on the MOSFET M1 RdsOn and thermal resistance, the power dissipation will be 200 mW and the maximum junction temperature will be 73° C.

The diode, D4, is a 600V, 3 A ultra fast rectifier with low forward voltage drop and thermal resistance. The predicted power dissipation is 312 mW at a junction temperature of 68° C.

The MOSFET M1 current sense resistor, R13 and R14, will dissipate a total of 256 mW, which is split evenly between two ½ W resistors. The sum of the power dissipation in the three main components of the driver is approximately 770 mW, leaving about 750 mW for the transformer and other components to achieve the target efficiency of 93%.

The transformer L2 has a primary inductance of 580 uH. It is realized as an EE core pair with a two section bobbin. The primary and secondary are wound side-by-side to maximize the leakage inductance, which improves the ripple current steering. The third winding is for auxiliary supply voltage to the control IC and is applied over the primary.

The following table provides illustrative component selections for one possible power supply in accordance with FIG. 4 and FIG. 5.

TABLE 2

Component Selection

| Component | Value |
|---|---|
| U1 | STMicro L6562 |
| U2 | Zetex ZXCT1008 |
| B1 | Fairchild DF06S |
| L1 | 100 uH |
| L2 | JA4205-BL |
| M1 | STB11NK40ZT4 |
| M2 | IRLML2402 |
| Q1 | MMBT5401LT1 |
| D1 | MMSD4148T1 |
| D2 | MMSD4148T1 |
| D3 | MMSZ15T1 |
| D4 | STTH3L06B |
| D5 | BZX84C15LT1 |
| D6 | MMSZ5268BT1 82 V |
| C1 | 0.1 uF |
| C2 | 10 nF |
| C3 | 2.2 uF |
| C4 | 47 nF |
| C5 | 47 uF |
| C6 | 0.1 uF |
| C7 | 10 nF |
| C8 | 100 pF |
| C9 | 0.1 uF |
| C10 | 1.0 uF |
| C11 | 1.5 uF |
| C12 | 10 uF |
| R1 | 619K |
| R2 | 619K |
| R3 | 10K |
| R4 | 182K |
| R5 | 182K |
| R6 | 16K |
| R7 | 22.1 |
| R8 | 18.2K |
| R9 | 1K |
| R10 | 10K |
| R11 | 4.7 |
| R12 | 22.1 |
| R13 | 2.32 |
| R14 | 2.32 |
| R18 | 20K |
| R19 | 0.0 |
| R20 | 0.33 |
| R21 | 1.82K |
| R22 | 1.54K |
| R23 | 1.37K |
| R24 | 619K |
| R25 | 619K |
| P1 | Jumper Selector |

It will be appreciated that the above selection of components is only one possible selection that provides a particular power supply. Various component selections can be made based on the design specification and requirements.

Figure 6:
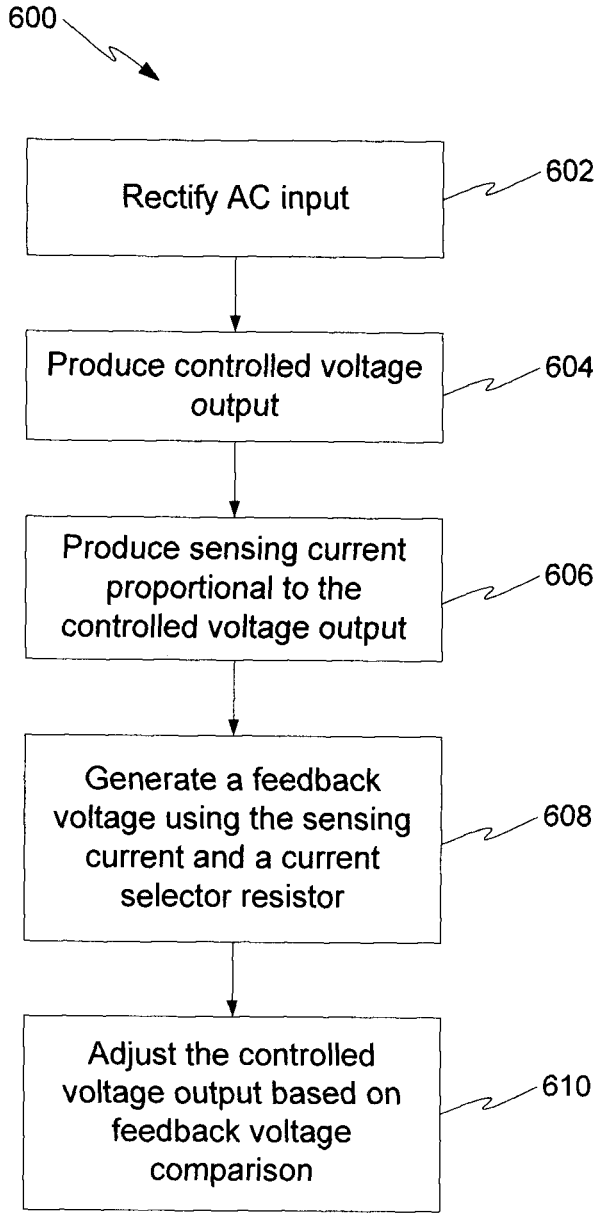
FIG. 6 depicts in a flow chart a method of controlling a lighting fixture.

FIG. 6 depicts in a flow chart a method 400 of controlling a lighting fixture. An alternating current (AC) input is rectified (602). A controlled voltage output is produced (604) from the rectified AC input using a PFC SEPIC controller. A sensing current proportional to the controlled voltage output is produced (606). The sensing current is produced by a current sensing circuit that is connected across a current sensing resistor. The current sensing resistor is connected in series with the controlled voltage output line. A feedback voltage is generated by the sensing current that passes through a current selector resistor (608). The feedback voltage is provided to a PFC controller. The current selector and the PFC controller are both connected to a common neutral or return line. The feedback voltage generated across the current selector resistor is relative to the common neutral or return line. The controlled voltage output is adjusted based on the feedback voltage (610). The controlled voltage output is adjusted to maintain the feedback voltage at a reference voltage.

Figure 7:
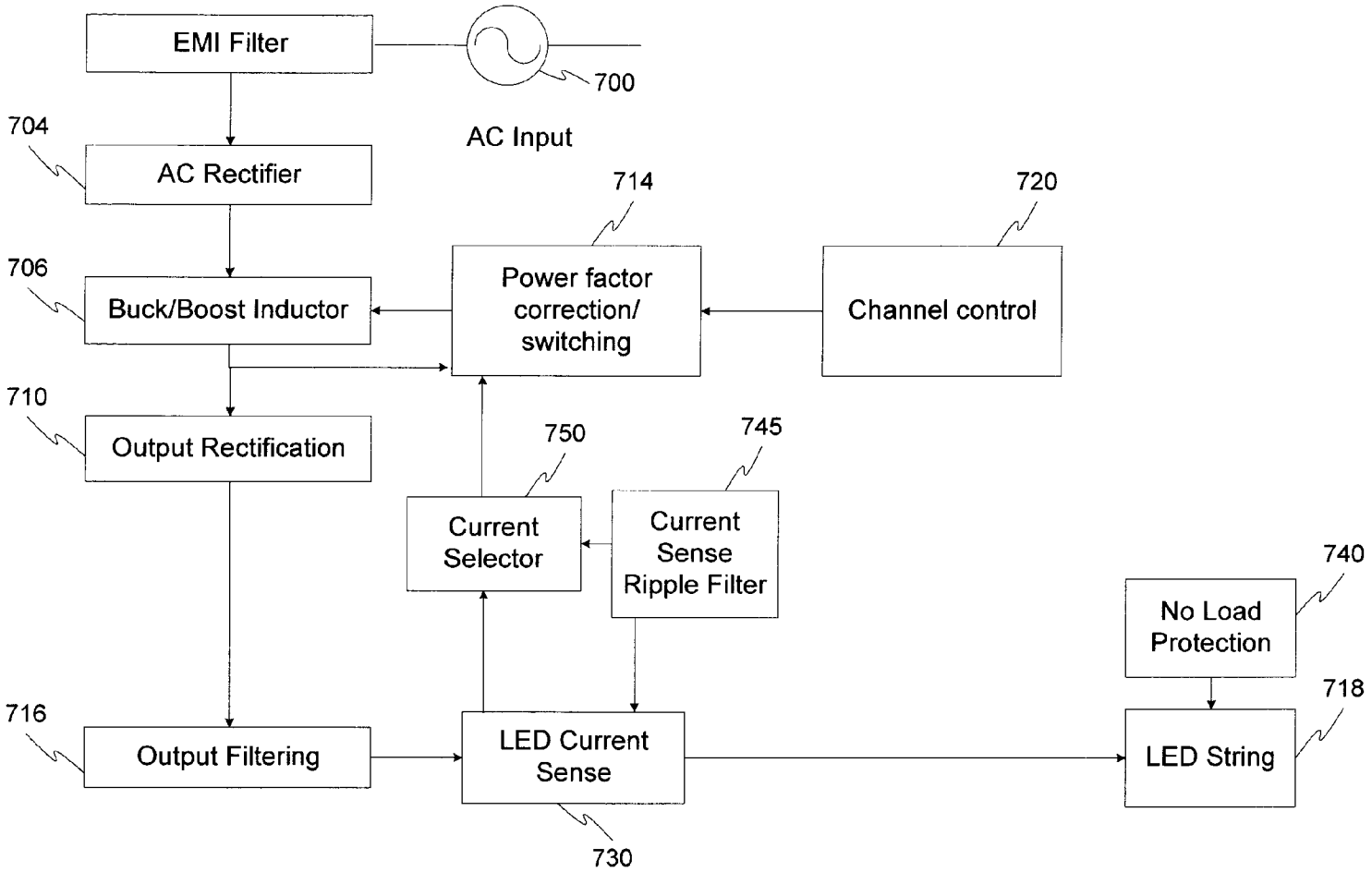
FIG. 7 depicts in a component flow diagram a process of powering an LED string.

FIG. 7 depicts in a component flow diagram a process of powering an LED string in a lighting fixture. An AC power source 700 provides an input AC signal that is fed to the EMI filter block 702. The EMI filter block 702 may limit any conducted interference introduced by the lighting fixture to the utility grid by removing harmonic noise and conducted emissions that could transfer to the grid. A bridge rectifier block 704 converts the AC input to a DC input. The power factor correction circuit (PFC) 714 receives the now rectified AC signal to produce the lower voltage by Buck/Boost inductor 706. The PFC circuit 714 uses the output of the AC rectifier block 704, a feedback voltage generated by current selector 750, as well as a monitored current that is filtered by current sense ripple filter 745 to control the output voltage produced by the buck/boost inductor 706. The buck/boost inductor 706 converts high DC voltage to lower DC voltage. Output rectification block 710 and filtering block 716 are provided to reduce ripple from voltage and current to provide a cleaner output. The reduced voltage waveform is provided to drive the LED's 718. A current sense block 730 produces an output current to the current selector that is proportional to the current in the power line of the LED's. The current selector 750 generates a voltage which is directly proportional to the current flowing to the LED's based on the output current produced by the current sense block 730. The current sense ripple filter 745 filters the current waveform that is sensed by the PFC circuit 714 which can provide more stable operation of the lighting fixture. A no load protection module 740 is provided to ensure protection of the power supply when no load is connected.

Figure 8:
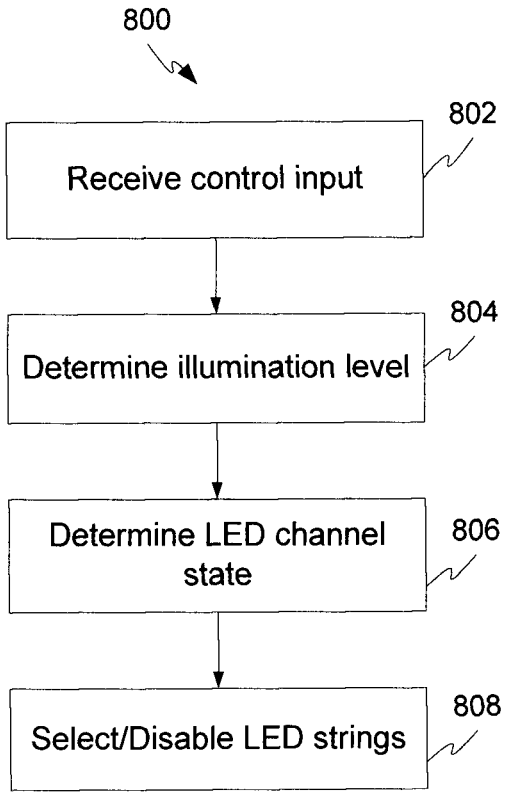
FIG. 8 shows a method of controlling multiple LED channels.

FIG. 8 shows a method of controlling multiple LED channels. An input is received 802 by the light controller to provide a control of the illumination level required by the light fixture. The input such as remote wired or wireless input, ambient light sensor, light output or motion sensors input, or determining the age of the fixture and LED degradation can be used to determine what the illumination level 804 is targeted or desired. The determined illumination level is used to determine the number of channels required to achieve the desired light output. The LED channel state 806 can then be determined. The appropriate channels can then be enabled or disabled to achieve the desired light out put at 808. The illumination level may be determined on such factors as ambient light, output degradation, special events.

Figure 9:
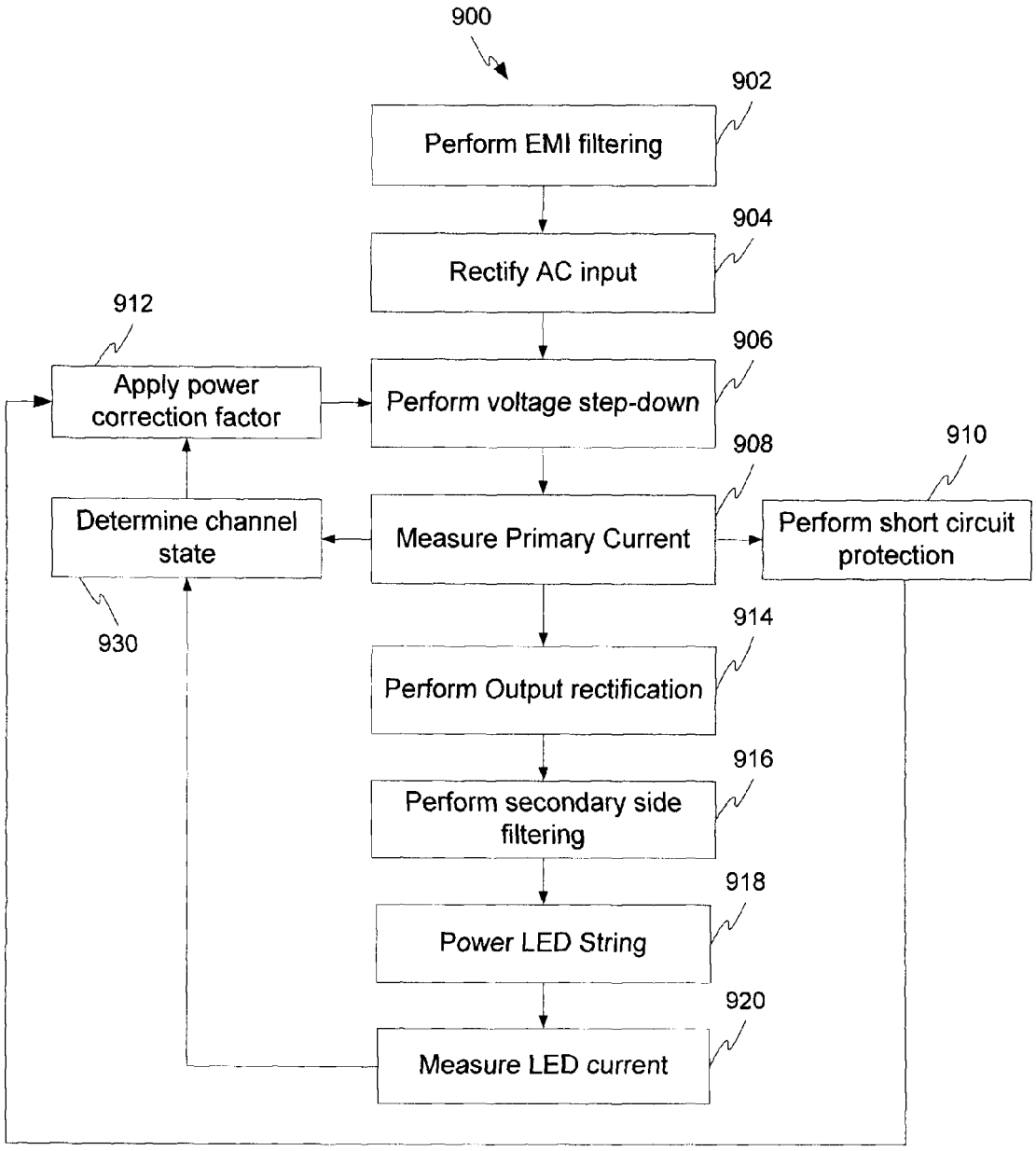
FIG. 9 depicts in a flow chart a method of powering an LED string.

FIG. 9 depicts in a flow chart a method of powering an LED string. EMI filtering of incoming AC current is performed at 902. The AC input is then rectified at 904 to convert the AC to full-wave DC voltage and current. At 906 the high DC voltage is converted to lower voltage DC, for example voltage step-down is performed from 165 Volts to 36 Volts. The primary current is monitored at 908 for power factor correction by PFC circuit 114. If current exceeds design tolerances short circuit protection is performed by the PFC circuit at 910. Based upon the determined current, a correction factor can be applied to ensure current tolerances at 912. Output rectification is performed at 914 to reduce ripple from voltage and current to provide cleaner output. Secondary side filtering is then performed at 916 and the current is then applied to the LED engine at 918. The LED current is measured at 920. The micro-controller can then average current signal to perform an averaging function to high ripple LED current. The output mode of the LED is then determined at 930 where the micro-controller is programmed to control the state of an LED channel.

The current power on cycle can be determined by the micro-controller and determine the "age" of the fixture by counting power on cycles. The micro-controller can determine the required LED current to achieve the desired output. The micro-controller can then send a feedback signal to the power factor correction circuit to adjust the required current to the LED by calculating the desired feedback voltage output based on the gathered data. External input may also be provided to the micro-controller such as signals from motion sensors, a wireless TX/RX interface or ambient light and/or light output sensor. Additional input may be provided in calculating the desired on/off state, light intensity or current required to maintain a light intensity of the LED fixture.

A power supply according to the present disclosure may be designed to accept any input voltage, including two standard input voltages; i.e., 120 Vac, 60 Hz (North American Voltage) or 240 Vac, 50 Hz (European Voltage). For each input voltage a separate power supply is used. The design is the same with only several changes in component values for each version to accept the lower or higher voltage and different frequencies. This method may be used over typical universal input voltage design as it keeps efficiency as high as possible by optimizing the component values for each supply and its corresponding input rather than making a compromise so that the power supply can work at all levels.

As described above, it is possible to control the light output by a lighting fixture by controlling the number of LED channels that are turned on. Further output level control may be provided by controlling the brightness of each LED channel. This brightness control may be accomplished by varying the resistance of the current selector resistor which will change the current provided to the LEDs. The output level may be adjusted in other ways as well, for example by limiting the current provided by the power controller prior to the LED load.

If the light control can adjust amount of current going to the LEDs, it may do so by initially providing the minimum amount of current to the LED's to provide the minimum lumen output as required by IES standards. The current may then be adjusted to gradually increases the current over time to maintain the lumen output to compensate for the natural reduction of lumen output by the aging LED's (LEDs decrease in output by 20% over 20 years). Running the LED's at lower currents make them much more efficient as they run much cooler. This can provide significant savings over HPS fixtures which need to have higher initial output (lumens) to maintain proper IES light levels towards the end of their life.

If the lighting fixture includes a light controller to control operation of one or more LED channels, other control schemes can easily be added such as motion detection to turn on or increase (or decrease) light levels when a vehicle or pedestrian is present, temperature compensation to reduce current to the LED's if they are running too hot ensuring a longer life, time of day dimming to have the light turn on or adjust light levels to coincide with traffic cycles, and remote control operation (wireless) to allow a remote programmable control that allows for changes in light levels in real time or change the programming of the micro for particular events such as festivals, emergencies, tourist season.

Certain adaptations and modifications of the described embodiments can be made. Therefore, the above discussed embodiments are considered to be illustrative and not restrictive.

What is claimed is:

1. A power supply for providing a constant current to a light emitting diode (LED) load, the power supply comprising:

a power controller receiving an alternating current (AC) input and providing a direct current (DC) output voltage controlled to maintain a constant feedback voltage, the DC output voltage provided to a high side of the LED load, the DC output voltage relative to a common power line coupled to a low side of the LED load and the power controller;

a current sense resistor connected in series on the high side of the LED load;

a current sensing circuit coupled across the current sense resistor providing a reference current at an output line proportional to a current sense voltage across the current sense resistor; and a current selector resistor coupled between the output line of the current sensing circuit and the common power line coupled to the low side of the LED load, the current selector resistor and the reference current generating a current-sensed voltage for use as the feedback voltage used by the power controller;

wherein the DC output voltage provided by the power controller is controlled to provide a constant current to the LED load.

2. The power supply of claim 1, further comprising:

a current sense ripple filter capacitor connected in parallel with the current selector resistor to smooth the reference current and the current-sensed voltage to provide stable operation of the power controller.

3. The power supply of claim 1 wherein the power controller is a power factor correction (PFC) single-ended primary-inductor converter (SEPIC).

4. The power supply of claim 1, further comprising a plurality of current selector resistors, wherein the current selector resistor coupled between the output line of the current sensing circuit and the common power line is selectable from the plurality of current selector resistors.

5. The power supply of claim 4, wherein the current selector resistor is selected from the plurality of current selector resistors using at least one of:

a jumper; or a controllable switch.

6. The power supply of claim 1, further comprising:

a no-load protection circuit coupled to the high side of the LED load and the output line of the current sensing circuit.

7. The power supply of claim 1, further comprising:

a no-load zener diode coupled to the high side of the LED load and the output line of the current sensing circuit.

8. The power supply of claim 1, further comprising:

a current sensing circuit protection circuit for protecting the current sensing circuit from an over-voltage.

9. The power supply of claim 8, wherein the current sensing circuit protection circuit forms part of the current sensing circuit.

10. The power supply of claim 1, further comprising a disable circuit for disabling the output of the power controller based on a received signal.

11. A lighting fixture for mounting above an illumination surface, the lighting fixture comprising a housing supporting:

a light emitting diode (LED) light string for illuminating the illumination surface; and a power supply for providing a constant current to a light emitting diode (LED) load, the power supply comprising:

a power controller receiving an alternating current (AC) input and providing a direct current (DC) output voltage controlled to maintain a constant feedback voltage, the DC output voltage provided to a high side of the LED load, the DC output voltage relative to a common power line coupled to a low side of the LED load and the power controller;

a current sense resistor connected in series on the high side of the LED load;

a current sensing circuit coupled across the current sense resistor providing a reference current at an output line proportional to a current sense voltage across the current sense resistor; and a current selector resistor coupled between the output line of the current sensing circuit and the common power line coupled to the low side of the LED load, the current selector resistor and the reference current generating a current-sensed voltage for use as the feedback voltage used by the power controller;

wherein the DC output voltage provided by the power controller is controlled to provide a constant current to the LED load.

12. The lighting fixture of claim 11, wherein the power supply further comprises:

a current sense ripple filter capacitor connected in parallel with the current selector resistor to smooth the reference current to provide stable operation of the power controller.

13. The lighting fixture of claim 11 further comprising:

a light controller for controlling operation of the power supply.

14. The lighting fixture of claim 13, further comprising:

one or more additional LED light strings; and one or more additional power supplies, each additional power supply for providing a constant current to a respective one of the one or more additional LED light strings, wherein the light controller is further for controlling operation of each of the one or more additional power supplies based on the value of the at least one variable measured by the input sensor.

15. The lighting fixture of claim 14, wherein each power supply and the one or more power supplies further comprise a disable circuit for disabling the output of the power controller based on a received signal from the light controller.

16. The lighting fixture of claim 14, wherein the light controller can turn off individual LED light strings.

17. The lighting fixture of claim 14, wherein the power supply and each of the one or more additional power supplies are contained on a single PCB, and wherein the power supply and each of the one or more additional power supplies each comprise a bridge rectifier and a separate return plane.

18. The lighting fixture of claim 11, further comprising:

at least one input component for providing at least one input signal;

a light controller for controlling operation of the power supply based on the at least one input signal.

19. The lighting fixture of claim 18, wherein the at least one input component comprises at least one of:

a light sensor for measuring ambient light;

a light sensor for measuring light output from the lighting fixture;

a motion sensor for measuring movement;

a temperature sensor for measuring ambient temperature;

a temperature sensor for measuring a temperature of the lighting fixture;

a wired transceiver for receiving signals, transmitting signals or both receiving and transmitting signals to a remote location;

a wireless transceiver for receiving signals, transmitting signals or both receiving and transmitting signals to a remote location; and an clock for producing a timing signal.

20. The lighting fixture of claim 11 further comprising an electromagnetic interference (EMI) filter and thermal protection on the incoming AC input.

21. A method of controlling a lighting fixture, the method comprising:

rectifying an alternating current (AC) input;

producing a controlled voltage output from the AC input using a single ended primary inductance converter;

producing a sensing current proportional to the controlled voltage output using a current sense resistor in series with the controlled voltage output and a current sensing circuit connected across the current sense resistor;

generating a feedback voltage using the sensing current and a current selector resistor; and adjusting the controlled voltage output to maintain the feedback voltage at a reference voltage, wherein the controlled voltage output provides a constant current to an light emitting diode (LED) load.

22. The method of claim 21, further comprising:

smoothing the sensing current using a current sense ripple filter capacitor.

23. The method of claim 21, further comprising:

controlling a plurality of LED channels to provide different illumination levels using a lighting controller capable of controlling a power supply of each LED channel, each power supply producing the controlled voltage output from the AC input using a single ended primary inductance converter.

24. The method of claim 21, further comprising:

limiting the controlled voltage output to a maximum voltage using a zener diode to prevent damage when no LED load is present.

* * * * *